US010386163B2

(12) United States Patent
Lee et al.

(10) Patent No.: US 10,386,163 B2
(45) Date of Patent: Aug. 20, 2019

(54) FOLDING ARTICULATING MISSILE FIN HAVING SLIDING BLOCK DETENT MECHANISM AND GUIDED MISSILE

(71) Applicant: AGENCY FOR DEFENSE DEVELOPMENT, Daejeon (KR)

(72) Inventors: Dong-Hoon Lee, Daejeon (KR); Jung-Young Kim, Daejeon (KR); Choon-Gil Kang, Sejong (KR); Dong-Min Lee, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 414 days.

(21) Appl. No.: 15/218,228

(22) Filed: Jul. 25, 2016

(65) Prior Publication Data

US 2017/0138708 A1 May 18, 2017

(30) Foreign Application Priority Data

Aug. 13, 2015 (KR) ..... 10-2015-0114426

(51) Int. Cl.
*F42B 10/14* (2006.01)

(52) U.S. Cl.
CPC ..... *F42B 10/14* (2013.01)

(58) Field of Classification Search
CPC ..... F42B 10/14; F42B 10/16; F42B 10/18
See application file for complete search history.

(56) References Cited

U.S. PATENT DOCUMENTS

| | | | | |
|---|---|---|---|---|
| 3,125,956 A * | 3/1964 | Kongelbeck | F42B 10/16 | 244/3.29 |
| 3,946,969 A | 3/1976 | Marburger et al. | | |
| 5,326,049 A * | 7/1994 | Rom | F42B 10/14 | 102/388 |
| 7,097,132 B2 * | 8/2006 | Banks | F42B 10/14 | 244/3.27 |
| 7,552,892 B1 | 6/2009 | Bittle et al. | | |
| 7,628,354 B2 * | 12/2009 | Lee | F42B 10/14 | 244/3.29 |

FOREIGN PATENT DOCUMENTS

| | | |
|---|---|---|
| KR | 10-1997-0047783 A | 7/1997 |
| KR | 10-2007-0094806 A | 9/2007 |

* cited by examiner

*Primary Examiner* — Brian M O'Hara
(74) *Attorney, Agent, or Firm* — LRK Patent Law Firm

(57) ABSTRACT

A folding articulating missile fin having a sliding block detent mechanism and a guided missile. The folding articulating missile fin includes a sliding block detent mechanism composed of the sliding block elastically supported by a spring and sliding in a guide groove of a lower fin, a hinge pin allowing an upper fin and a lower fin to be unfolded, and a pair of upper and lower stop rings retaining opposite ends of the hinge pin, in which when the upper fin that has been unfolded is fully folded, the upper fin keeps folded in contact with the sliding block, and when the upper fin having been folded is unfolded, the upper fin remain unfolded and in contact with the sliding block. Accordingly, the structure related to the spring is simplified, and since a sliding-type mechanism is used, the folding fin can be quickly assembled.

7 Claims, 6 Drawing Sheets

FOLDING ARTICULATING MISSILE FIN HAVING SLIDING BLOCK DETENT MECHANISM AND GUIDED MISSILE

CROSS REFERENCE TO RELATED APPLICATION(S)

This application claims the benefit of Korean Patent Application No. 10-2015-0114426, filed on Aug. 13, 2015, which is hereby incorporated by reference in its entirety into this application.

BACKGROUND OF THE INVENTION

1. Technical Field

The present invention relates generally to a folding articulating missile fin and, more particularly, to a folding articulating missile fin having a fin detent structure simplified by a sliding block, and a guided missile.

2. Description of the Related Art

In general, various guided weapons that are launched out of a launch tube, including missiles, are equipped with folding fins, and the folding fins provide a spatial advantage because they are folded on the bodies using detent mechanisms for folding and unfolding the fins.

For example, a spring detent mechanism, which is one of the detent mechanisms for folding fins, fixes fins unfolded from a missile launched out of a launch tube in order to prevent the fins being folded back by using the characteristic whereby compressive force depends on the compressive length of a spring.

Therefore, the spring detent mechanism is generally used for small-sized folding fins.

However, the spring detent mechanism requires an assistant mechanism for converting the compressive force of a spring into the force for fixing fins, which complicates the structure of folding fins and makes design difficult.

In particular, excessive spring force beyond a predetermined level inevitably causes a large shock when the folding fins are operated.

SUMMARY OF THE INVENTION

The present invention has been made keeping in mind the above problems occurring in the prior art, and an object of the present invention is to provide a folding articulating missile fin having a sliding block detent mechanism that can simplify a structure related to a spring by using a sliding block moving with a change in compressive force of the spring to fix fins, and that can make it possible to quickly assemble folding fins in a sliding manner, and a guided missile.

In order to accomplish the above object, the present invention provides a folding articulating missile fin having a sliding block detent mechanism that includes: a lower fin, which is coupled to the body of a guided missile and has an upper fin-fixing portion having a folding angle on one side thereof; an upper fin, which is coupled to the lower fin through coupling of a lower fin-fixing portion to the upper fin-fixing portion and is folded to the body of the guided missile or unfolded from the body of the guided missile when the lower fin-fixing portion is folded with respect to the upper fin-fixing portion by the folding angle; and a sliding block, which is disposed on the lower fin to come in contact with the upper fin when the upper fin is folded or unfolded, pushed by the upper fin when the upper fin is folded, and retained by the upper fin when the upper fin is fully folded, and which fixes the fully unfolded upper fin by pushing the upper fin using the restoring force of a spring when the upper fin is unfolded, the sliding block being retained by the fixing force generated by contact with the front end of the lower fin-fixing portion, thereby keeping the upper fin unfolded from the lower fin by the folding angle.

The sliding block may be elastically supported by the spring in a guide groove of the upper fin-fixing portion of the lower fin. The sliding block may include an insert boss, which is fitted in and slides in the guide groove, and a fixing body, which protrudes from the guide groove while in contact with the upper fin, the insert boss and the fixing body forming a T-shape and the guide groove being straight.

The lower fin-fixing portion of the upper fin and the upper fin-fixing portion of the lower fin are coupled by a hinge pin such that the upper fin surrounds the lower pin, the hinge pin may function as the rotational center of the upper fin when the upper fin is folded and unfolded, and the hinge pin may be retained at opposite ends by a pair of upper and lower stop rings.

The upper fin may include upper and lower connectors arranged parallel to each other with a gap therebetween, the upper fin-fixing portion of the lower fin may be fitted in a space formed by the upper connector and the lower connector, and the hinge pin may be disposed through the upper connector, the lower connector, and the upper fin-fixing portion.

Further, the present invention provides a guided missile includes a folding fin composed of a lower fin having a folding angle on one side, an upper fin coupled to the lower fin and folded or unfolded by the folding angle, a sliding block retained by the upper fin when the upper fin is folded and retained by a fixing force generated by contact with the lower fin when the upper fin is unfolded, thereby keeping the upper fin fully unfolded from the lower fin by the folding angle, and a spring, which pushes the sliding block when the upper fin is unfolded; and a body, which is combined with the lower fin and loaded into a launch tube with the upper fin is folded.

According to the folding fin of the present invention, since the force for fixing a fin is obtained by moving the sliding block, the structure of the folding fin mechanism can be simplified and thus the folding fin can be quickly assembled.

Further, according to the folding fin of the present invention, since a sliding block detent type using a sliding manner is applied, it is possible to minimize free-play of the folding fin.

Further, according to the folding fin of the present invention, since the combination of the upper fin with the lower fin is fixed by a sliding block instead of a fixing aperture, it is possible to simplify the structure of the upper fin.

Further, a guided missile of the present invention uses the folding articulating missile fin having the sliding block detent mechanism, so it can be efficiently loaded into a launch tube.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
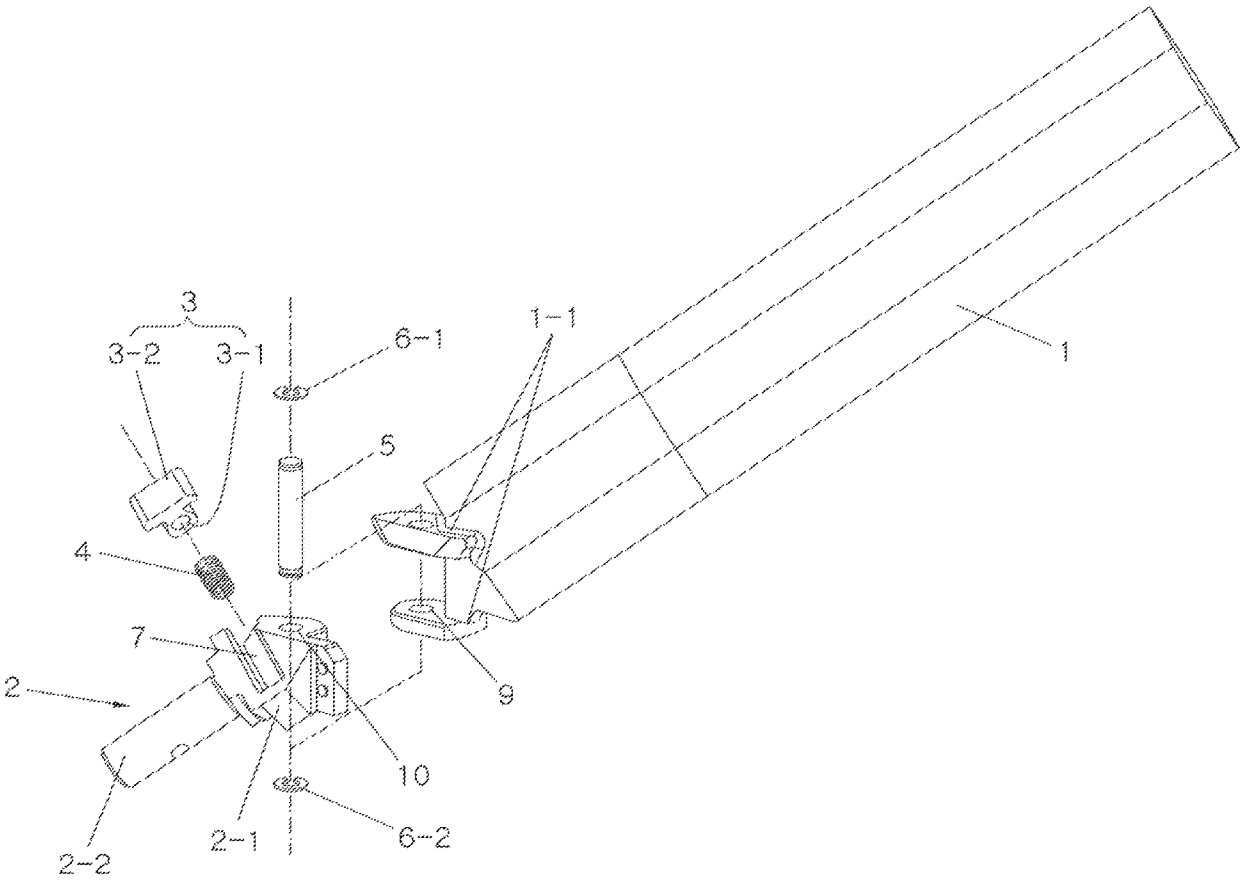
FIG. 1 is an exploded view of a folding articulating missile fin having a sliding block detent mechanism that is applied to a guided missile according to the present invention.

The present invention will be described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clearer.

Figure 2:
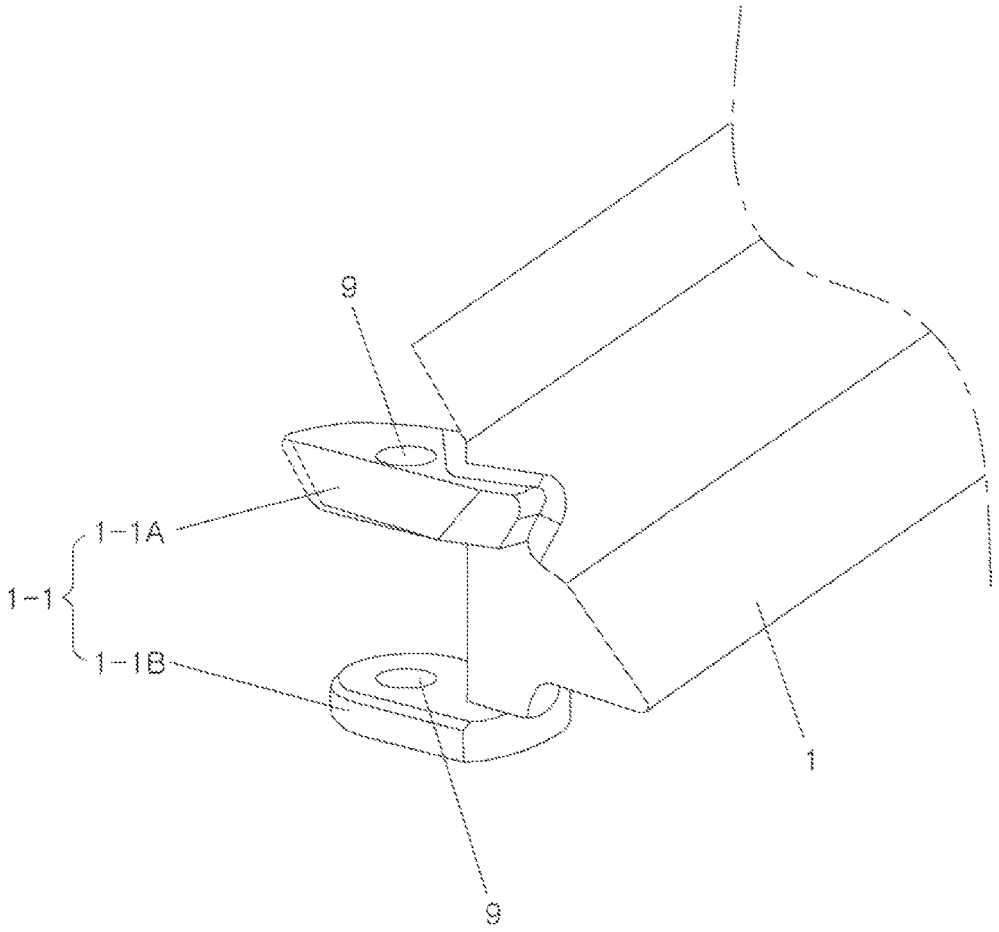
FIG. 2 is a view showing in detail an upper fin of the folding fin according to the present invention.
Figure 3:
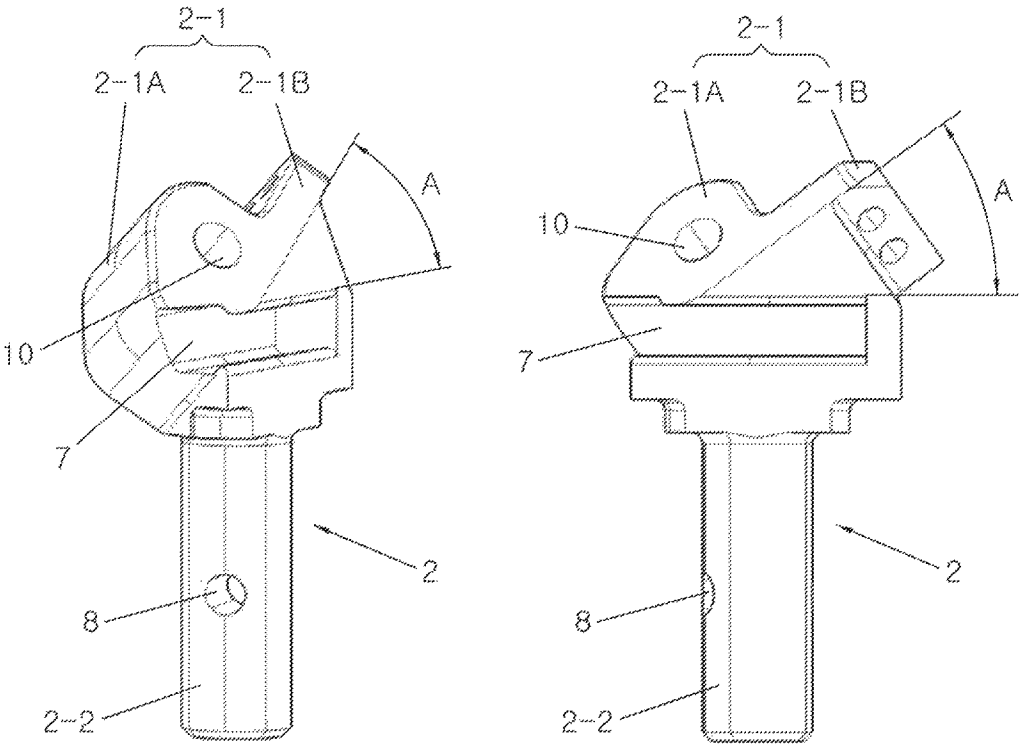
FIG. 3 is a view showing in detail a lower fin of the folding fin according to the present invention.

FIGS. 1, 2, and 3 show the configuration of a folding articulating missile fin having a sliding block detent mechanism that is applied to a guided missile according to an embodiment.

As shown in FIG. 1, a folding fin that is applied to the body of a guided missile includes an upper fin 1, a lower fin 2, and a sliding block detent mechanism.

In detail, the upper fin 1 is folded on the body of a guided missile, the missile is loaded into a launch tube, and then the upper fin 1 is unfolded from the body after the guided missile is launched from the launch tube, the upper fin having a lower fin-fixing portion 1-1 coupled to the lower fin 2.

Referring to FIG. 2, the lower fin-fixing portion 1-1 is composed of an upper connector 1-1A and a lower connector 1-1B arranged parallel to each other with a gap therebetween. In particular, an upper fin hinge pin hole 9 is formed through each of the upper and lower connectors 1-1A and 1-1B.

In detail, the lower fin 2 has an upper fin-fixing portion coupled to the upper fin 1 and a fixing shaft 2-2 that is inserted into the body of a guided missile so as to be fixed to the body of the guided missile.

Referring to FIG. 3, the upper fin-fixing portion 2-1 has a connector boss 2-1A having a width such that it is capable of being fitted between the upper and lower connectors 1-1A and 1-1B, an extension boss 2-1B protruding at a folding angle A from a side of the connector boss 2-1A, and a horizontal and straight guide groove 7 under the connector boss 2-1A, with an open end facing the connector boss 2-1A and a blocked end facing the extension boss 2-1B. In particular, a lower fin hinge pin hole 10 is formed through the connector boss 2-1A and is connected to a sliding block detent mechanism together with the upper fin hinge pin holes 9 of the upper and lower connectors 1-1A and 1-1B when the upper and lower connectors 1-1A and 1-1B are combined.

The fixing shaft 2-2 is a shaft body that extends from the upper fin-fixing portion 2-1 and is inserted into the body of a guided missile, and a shaft hole 8, into which a pin of the body of a guided missile is fitted, is formed radially through the shaft body to fix the lower fin 2 to the body of the guided missile.

In particular, the folding angle A allows the upper and lower connectors 1-1A and 1-1B to be folded with respect to the connector boss 2-1A, so the upper fin 1 combined with the lower fin 2 can be folded onto the body of a guided missile.

In detail, the sliding block detent mechanism includes a sliding block 3 having an insert boss 3-1 and a fixing body 3-2, which make a T-shape, a spring 4 disposed in a guide groove 7 and elastically supporting the sliding block fitted in the guide groove 7, a hinge pin 5 fitted in the upper fin hinge pin hole 9 and the lower fin hinge pin hole 10 and fastening the connector boss 2-1A to the upper and lower connectors 1-1A and 1-1B, and a pair of upper and lower stop rings 6-1 and 6-2 retaining opposite ends of the hinge pin 5. In particular, the spring 4 is a compressive coil spring and the upper and lower stop rings 6-1 and 6-2 are E types.

Figure 4:
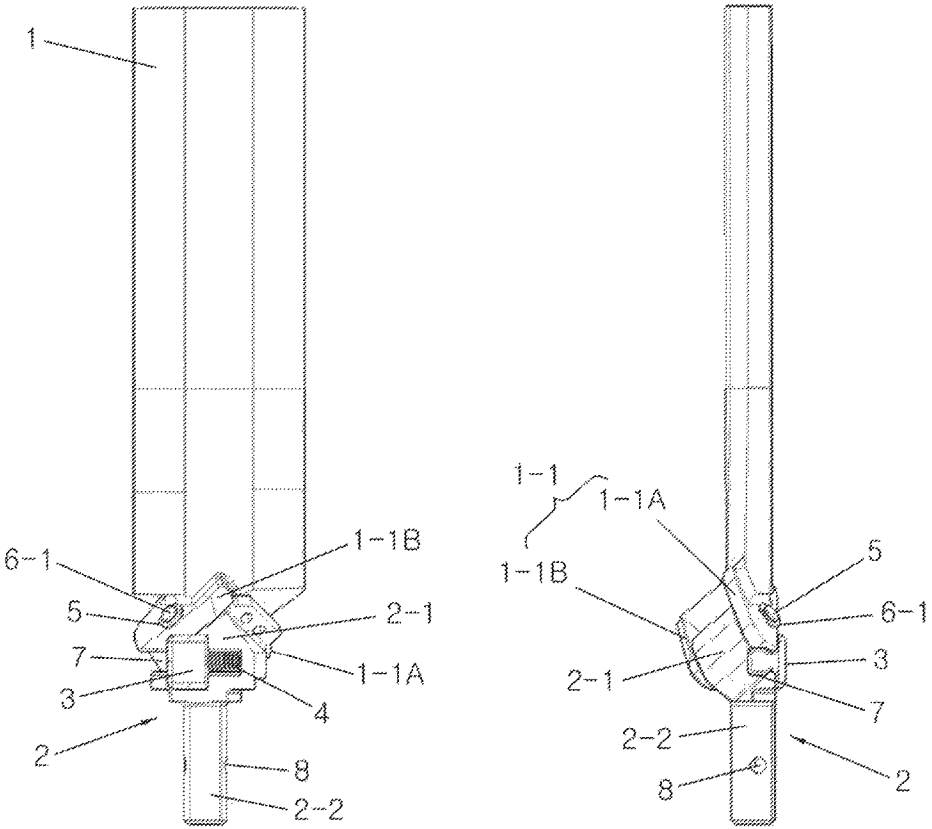
FIG. 4 is a view when the folding articulating missile fin having the sliding block detent mechanism according to the present invention is combined with a guided missile.

FIG. 4 is a view showing an assembly of the upper fin 1 and the lower fin 2 combined by a sliding block detent mechanism.

As shown in the figure, the hinge pin 5 is fitted in the upper fin hinge pin hole 9 of the upper and lower connectors 1-1A and 1-1B and the lower fin hinge pin hole 10 of the connector boss 2-1A and the E-type upper and lower stop rings 6-1 and 6-2 fix the opposite ends of the hinge pin 5. Further, in the sliding block 3, the fixing body 3-1 protrudes from the guide groove 7 and the spring 4 is disposed in the guide groove 7, with the insert boss 3-1 fitted in the guide groove 7.

Accordingly, the sliding block detent mechanism functions as an assembly that combines the upper fin 1 and the lower fin 2.

Figure 5:
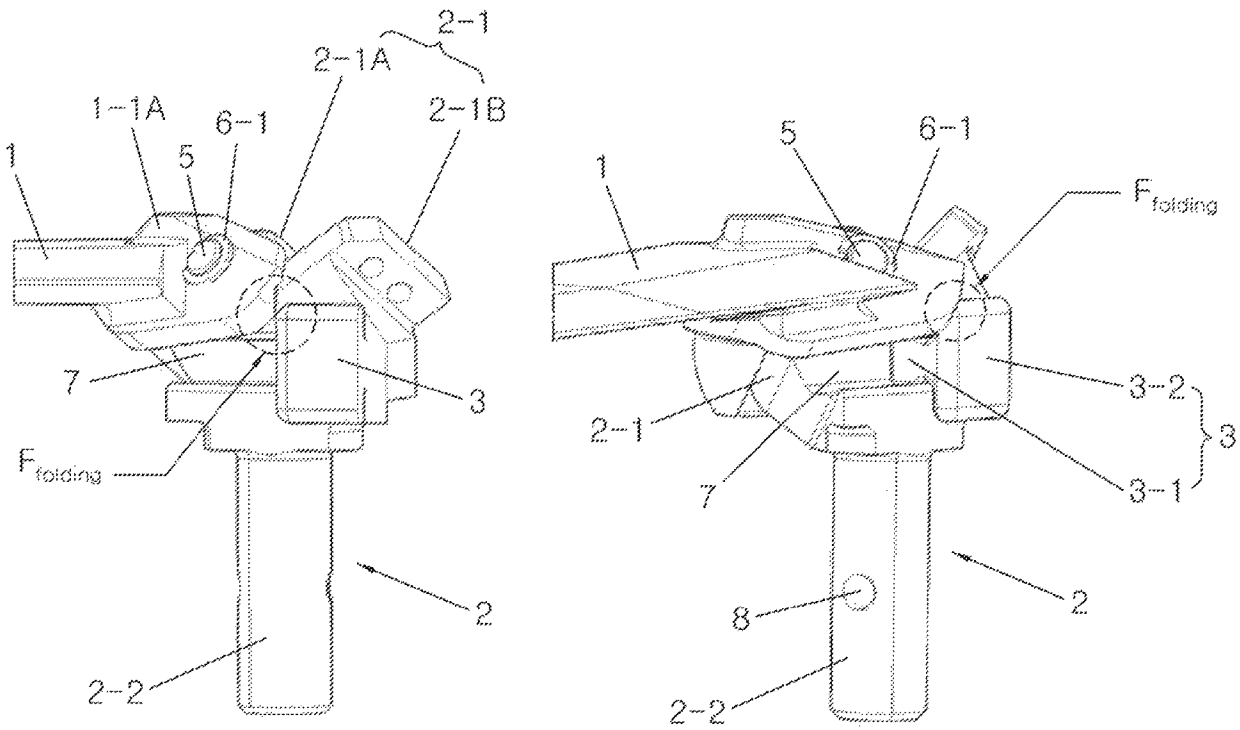
FIG. 5 is a view when the folding fin according to the present invention is folded and fixed to the body of a guided missile by a sliding block.

FIG. 5 shows the operation of the sliding block detent mechanism when the upper fin land the lower fin 2 are folded.

As shown in the figure, when the folding fin is loaded into a launch tube and the upper fin 1 is folded, the upper fin 1 is folded toward the body of a guided missile by the upper and lower connectors 1-1A and 1-1B that are folded by the folding angle A around the hinge pin 5. In this process, a pushing force is applied to the sliding block 3 combined with the guide groove 7 by the insert boss 3 through the fixing body 3-2 from the upper connector 1-1A. Accordingly, the sliding block 3 is pushed out of the guide groove 7 while pressing the spring 4, so the spring 4 is compressed. Further, when the upper and lower connectors 1-1A and 1-1B are fully folded by the folding angle A, the upper connector 1-1A is brought into contact with the fixing body 3-2 of the sliding block 3 and the spring 4 is maximally compressed by the sliding block 3. As a result, the sliding block 3 is retained by a fixing force $F_{folding}$ generated by the front ends of the fixing body 3-2 and the upper connector 1-1A, so the upper fin 1 is folded to the body of a guided missile from the lower fin 2. The fixing force $F_{folding}$ is maintained in the launch tube.

Figure 6:
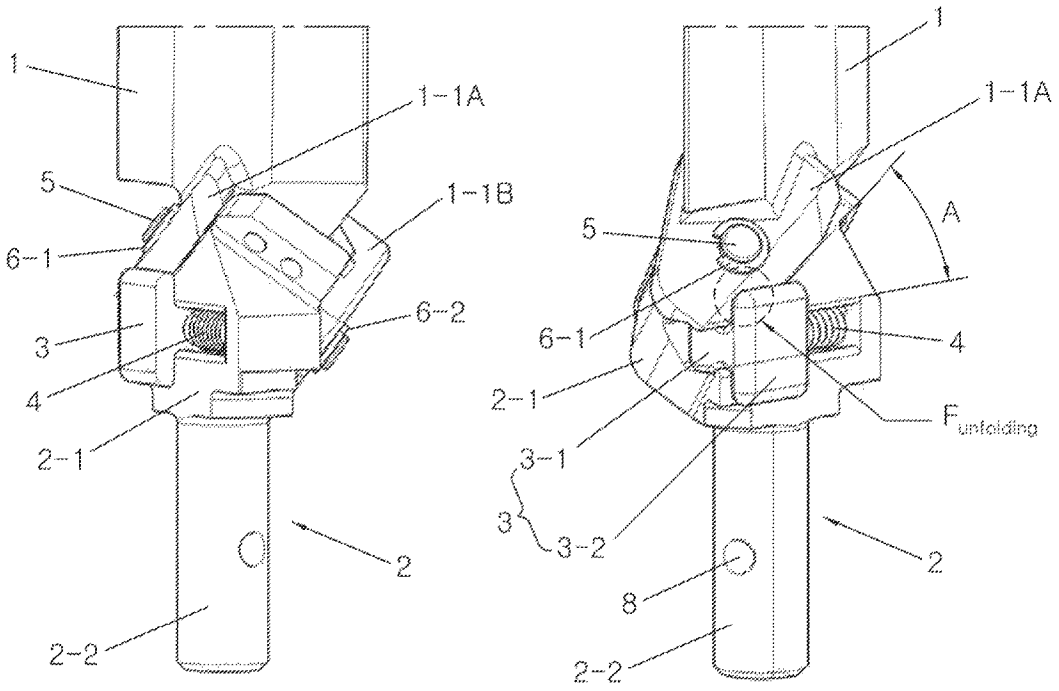
FIG. 6 is a view when the folding fin according to the present invention is fully unfolded from the body of a guided missile and fixed by a sliding block.

FIG. 6 shows the operation of the sliding block detent mechanism when the upper fin 1 and the lower fin 2 are unfolded.

As shown in the figure, when the guided missile is launched from the launch tube, the fixing force $F_{folding}$ that has been applied to the upper fin 1 and maintained in the launch tube is removed. Accordingly, a restoring force of the spring 4 is applied to the insert boss 3-1 of the sliding block 3, the upper connector 1-1A is pushed by the fixing block 3-2 of the sliding block 3, and the upper and lower connectors 1-1A and 1-1B are unfolded by the folding angle A around the hinge pin 5. Next, as the upper and lower connectors 1-1A and 1-1B are fully unfolded by the folding angle A, the upper connector 1-1A is brought into contact with the fixing body 3-2 of the sliding block 3 and the spring 4 maximally extends. As a result, the sliding block 3 is retained by the fixing force $F_{folding}$ generated by the front ends of the fixing body 3-2 and the upper connector 1-1A, so the upper fin 1 is fully unfolded from the lower fin 2 and the body of the guided missile. The fixing force $F_{unfolding}$ is maintained by the upper connector 1-1A held at the folding angle A by the fully unfolded upper fin 1.

As described above, the folding articulating missile fin having the sliding block detent mechanism according to this embodiment includes a sliding block detent mechanism composed of the sliding block 3 elastically supported by the spring 4 and sliding in the guide groove 7 of the lower fin 2, the hinge pin 5 allowing the upper fin 1 and the lower fin 2 to be unfolded, and the pair of upper and lower stop rings 6-1 and 6-2 retaining the opposite ends of the hinge pin 5, in which when the upper fin 1 having been unfolded is fully folded, the upper fin 1 remains folded and in contact with the sliding block 3, and when the upper fin 1 having been folded, is unfolded, the upper fin 1 remains unfolded and in contact with the sliding block 3. Accordingly, the structure related to the spring is simplified, and particularly, a sliding-type mechanism is used, so the folding fin can be quickly assembled.

As described above, the present invention provides a folding articulating missile fin having a sliding block detent mechanism, and a guided missile.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, optimal embodiments of the present invention have been disclosed in the drawings and the specification. Although specific terms have been used in the present specification, these are merely intended to describe the present invention and are not intended to limit the meanings thereof or the scope of the present invention described in the accompanying claims. Therefore, those skilled in the art will appreciate that various modifications and other equivalent embodiments are possible from the embodiments. Therefore, the technical scope of the present invention should be defined by the technical spirit of the claims.

What is claimed is:

1. A folding articulating missile fin having a sliding block detent mechanism, comprising:

a fin axle coupled to a body of a guided missile;

an upper fin coupled to the fin axle to be folded to the body of the guided missile or unfolded from the body of the guided missile; and a sliding block including a fixing body, and disposed on the fin axle to come into contact with the upper fin when the upper fin is folded or unfolded, the sliding block configured to be pushed by the upper fin when the upper fin is folded, the sliding block configured to be retained by the upper fin when the upper fin is fully folded, and the sliding block configured to fix the upper fin that is fully unfolded by pushing the upper fin using a restoring force of a spring when the upper fin is unfolded, wherein the upper fin includes an upper connector and a lower connector which are arranged parallel to each other with a gap therebetween, and wherein a folding position of the upper fin is retained by a fixing force generated by front ends of the fixing body and the upper connector.

2. The folding articulating missile fin of claim 1, wherein the sliding block is elastically supported by the spring in a guide groove of the fin axle.

3. The folding articulating missile fin of claim 2, wherein:

the sliding block further includes an insert boss fitted and sliding in the guide groove, the fixing body protrudes from the guide groove and is in contact with the upper fin, and the insert boss and the fixing body make a T-shape.

4. The folding articulating missile fin of claim 3, wherein the guide groove is formed straight.

5. The folding articulating missile fin of claim 1, wherein:

the upper fin and the fin axle are combined by a hinge pin, and the hinge pin functions as a rotational center of the upper fin when the upper fin is folded and unfolded.

6. The folding articulating missile fin of claim 5, wherein the hinge pin is retained at opposite ends by a pair of upper and lower stop rings.

7. The folding articulating missile fin of claim 5, wherein:

the upper fin is coupled to the fin axle by the hinge pin, the fin axle is fitted in a space formed by the upper connector and the lower connector, and the hinge pin is disposed through the upper connector, lower connector, and the fin axle.

* * * * *